United States Patent [19]

Knudson

[11] 4,039,063

[45] Aug. 2, 1977

[54] RUN-OUT APPARATUS AND METHOD FOR ROLL-FORMED PANELS

[76] Inventor: Gary A. Knudson, 17356 W. 57th Ave., Golden, Colo. 80401

[21] Appl. No.: 642,665

[22] Filed: Dec. 19, 1975

[51] Int. Cl.[2] ..... B21B 39/16

[52] U.S. Cl. ..... 193/35 R; 193/38; 72/420; 72/428; 72/169

[58] Field of Search ..... 72/169, 173, 177, 250, 72/419, 420, 426, 428; 193/35 R, 35 A, 35 J, 38; 198/233; 214/1 F

[56] References Cited

U.S. PATENT DOCUMENTS

| | | | |
|---|---|---|---|
| 501,659 | 7/1893 | Patterson, Jr. | 193/38 |
| 963,918 | 7/1910 | Miller | 193/38 X |
| 2,144,360 | 1/1939 | Buckbee | 198/233 |
| 2,708,511 | 5/1955 | Wilson et al. | 72/257 |
| 2,796,163 | 6/1957 | Lemm | 198/20 R |
| 3,003,612 | 10/1961 | Poundstone | 198/233 X |
| 3,237,440 | 3/1966 | Färber | 72/250 X |
| 3,339,392 | 9/1967 | Buckwalter et al. | 72/173 X |
| 3,420,080 | 1/1969 | Supina et al. | 72/173 X |
| 3,514,991 | 6/1970 | Merrill et al. | 72/420 |
| 3,842,647 | 10/1974 | Knudson | 72/177 |

FOREIGN PATENT DOCUMENTS

| | | | |
|---|---|---|---|
| 88,511 | 1/1958 | Netherlands | 193/38 |

*Primary Examiner*—Evon C. Blunk
*Assistant Examiner*—Richard K. Thomson
*Attorney, Agent, or Firm*—Ancel W. Lewis, Jr.

[57] ABSTRACT

Run-out apparatus and method for roll-formed panels includes a sectional run-out table providing a supporting surface of a selected length for panels formed by a forming section, a sectional support adjacent the run-out table providing a supporting surface of a selected length onto which formed panels are supported and positioned for feed to a curving section, and a sectional run-out table and guide assembly supports and maintains the curved panels in a curved course of travel of a selected radius as the curved panels are run out from the curving section. Each of the run-out table, support, and run-out table and guide assembly are made in sections to accommodate a variety of different panel lengths. Each of the table sections are pivotally connected together end-to-end, are releasably connected for ready assembly and disassembly, and further have legs that are adjustable in height to afford the leveling of the table sections and said support. The legs are anchored to the supporting surface to maintain the table sections and support in a fixed position for successive panel run-outs.

25 Claims, 12 Drawing Figures

RUN-OUT APPARATUS AND METHOD FOR ROLL-FORMED PANELS

FIELD OF THE INVENTION

The present invention relates to a novel apparatus and method for handling panels as they are run out of a forming and curving apparatus for panels.

BACKGROUND OF THE INVENTION

There is a considerable demand for relatively low cost buildings made from fabricated panels for commercial and agricultural purposes. In constructing such buildings it is highly desirable to be able to form the panels and connect the panels at the job site. In my earlier filed application Ser. No. 226,173 upon which several patents have issued, U.S. Pat. Nos. 3,842,647, 3,875,642 and 3,902,288, there are shown and described panels, apparatus and methods for roll-forming panels, and apparatus and methods for continuously seaming the panels at the joints to form a free-standing, self-supporting building structure at the job site.

The present invention relates to a novel run-out apparatus and method suitable for use in combination with the apparatus for roll-forming panels and connecting the formed panels which alloys the buildings and like structures to be constructed and assembled in a highly efficient manner.

Accordingly, it is an object of the present invention to provide for the support of roll-formed panels as they continuously run out of a forming section and as they are continuously fed into and run out from a curving section.

Another object of the present invention is to provide a novel apparatus and method that accommodates panels of different lengths and eliminates to a large extent the necessity of manual labor and supervisory personnel in the formation of and joining of roll-formed panels.

A further object of this invention is to provide an apparatus and method for handling relatively long, continuous roll-formed panels that is readily adjusted and adapted to fit to the contour of the ground and readily adjusted and adapted to accommodate panels of different lengths.

Yet a further object of the present invention is to provide apparatus for supporting roll-formed panels that is readily assembled and disassembled at the job site and is readily adapted to be releasably anchored to the ground and, once in place, allows for the continuous handling of continuous roll-formed panels without substantial adjustment.

SUMMARY OF THE INVENTION

In accordance with the present invention there is provided a sectional run-out table made up of top members each having a vertically adjustable leg assembly pivotally connected at the discharge end and releasably connected end-to-end to provide a selected length of panel-supporting surface at the discharge end of the panel forming section, a sectional support made up of a horizontal support member releasably inserted into a socket in the side of a table top member and having an adjustable leg assembly to adjust for level on which formed panels are supported for positioning and feeding into the curving section and a sectional run-out table and guide assembly made up of a plurality of top members each with an upstanding guide roller that supports and maintains the curved panel in a path along a selected radius as the curved panel is run out of the curving section. The legs of each section are adjusted to level the panel-supporting surfaces and are anchored to the supporting surface to permit the run-out of a plurality of panels of uniform size and shape without substantial adjusting.

Other objects, advantages and capabilities of the present invention will become more apparent as the description proceeds, taken in conjunction with the accompanying drawings, in which like parts have similar reference numerals and in which.

DESCRIPTION OF THE PREFERRED EMBODIMENTS

Figures 1, 2, 3, 4, 5:
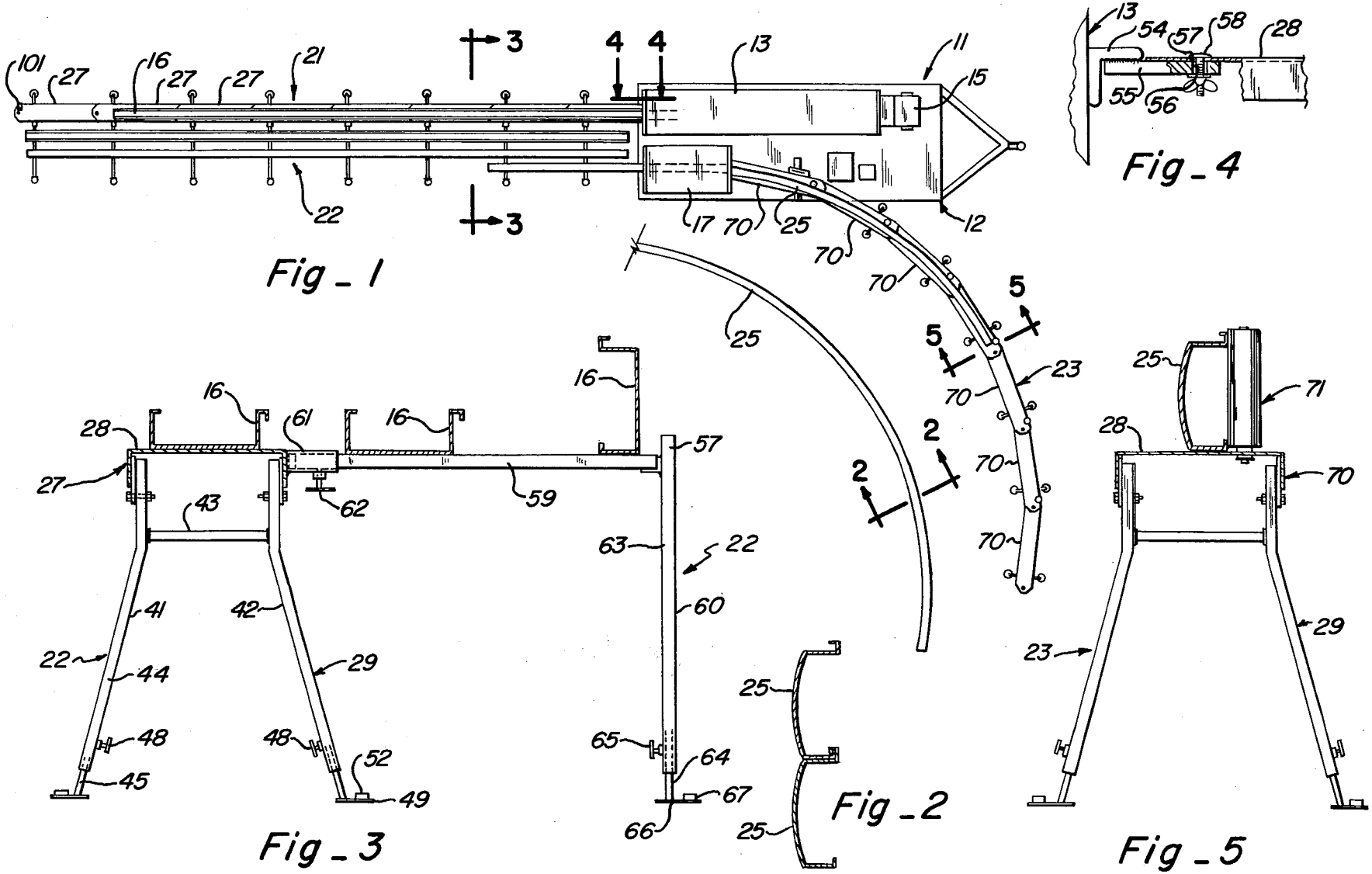
FIG. 1 is a top plan view of a run-out apparatus according to the present invention shown as operatively associated with panel-forming and curving apparatus.
FIG. 2 is a sectional view taken along lines 2—2 of FIG. 1 showing two curved panels connected together.
FIG. 3 is a sectional view taken along lines 3—3 of FIG. 1.
FIG. 4 is a sectional view taken along lines 4—4 of FIG. 1.
FIG. 5 is a sectional view taken along lines 5—5 of FIG. 1.

Referring now to the drawings, in FIG. 1 there is shown a portable, panel forming and curving apparatus generally designated by numerals 11 which includes a wheel-mounted, flatbed trailer 12 on which there is mounted a forming section 13 which receives a strip of flat sheet metal from a roll represented at 15 and roll-forms the sheet metal in a continuous roll-forming operation into a panel 16 having a generally U-shaped cross section with edge flanges along each side wall and a curving section 17 that imparts corrugations in the sides and bottom, a concavity to the bottom as well as an arc or curve of a selected radius into the panel along its length. The details of the panels, the forming section 13 and the curving section 17 are described in my earlier U.S. Pat. No. 3,842,647. As described in that patent, the panel-forming and cutting apparatus 11 is transported to the job site on the trailer, and the panels are first shaped and then connected side-by-side in a continuous seam to form a building which has straight side walls made up of a plurality of straight panels and a top made up of a plurality of curved panels. In practice, then, as with the panel-forming and curving apparatus 11, the run-out apparatus of the present invention is taken to the job site and is asssembled as shown and used in an operative association with panel-forming and curving apparatus 11.

The run-out apparatus shown in FIG. 1, in general, includes a sectional run-out table 21 arranged in a receiving relation to the forming section 13 and aligned longitudinally in the direction the panel runs out from the forming section, a sectional support 22 adjacent and generally parallel to the sectional run-out table, and a sectional run-out table and guide assembly 23 arranged in a curve or arc of a selected radius and in receiving relation to the curving section 17 that supports and at the same time maintains the panels in the desired arcuate or curved path as they run out as a continuous strip from the curving section 17.

In general in the operation, straight panels 16 run out as a continuous strip from the forming section 13, are supported on the sectional run-out table section 21, are cut to a selected length, are then manually moved from the run-out table onto the sectional support 22, are manually turned on one side, and are then manually fed into the curving section 17 where they are formed into a curved panel 25 having a selected radius which then proceeds onto the run-out table and guide assembly 23 where the curved panel is maintained in the curve or arc established by the curving section 17. The curved panels 25 are then placed on the ground and at least two and sometimes three of the panels are connected together side-by-side in a continuous side seam as shown in FIG. 2 by a seam-forming apparatus such as the one described in my U.S. Pat. No. 3,875,642. The joined two or three panels are then lifted onto the building site by an overhead crane or the like and joined along adjacent edges with those already in place to complete the roof of the building. The straight panels 16 are removed from the run-out table 21 or support 22 and joined together at the seams for construction of the end walls of the building.

Figures 6, 7, 8, 9, 10:
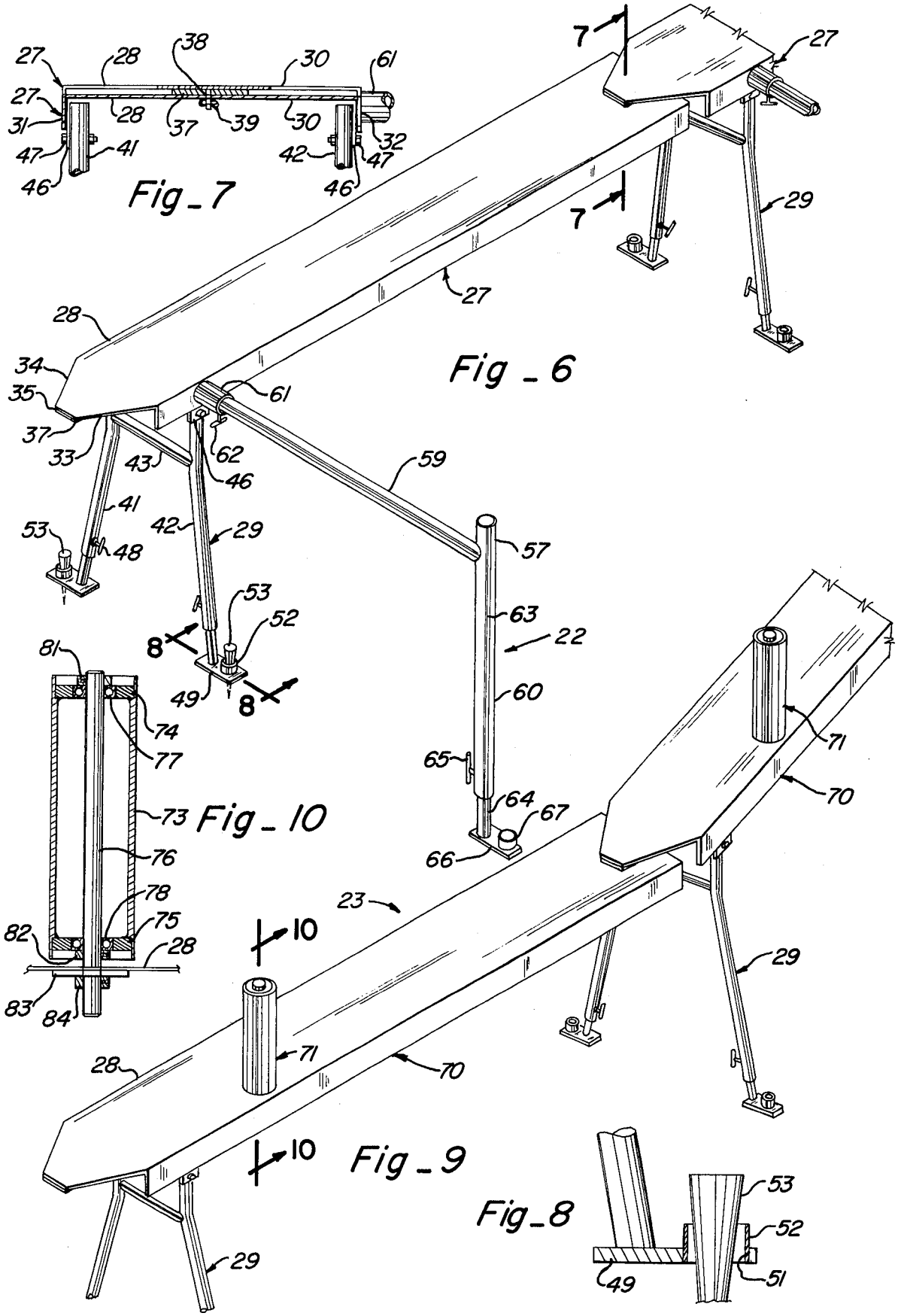
FIG. 6 is a perspective view of one and a portion of another of the table sections of the sectional run-out table of FIG. 1.
FIG. 7 is a sectional view taken along lines 7—7 of FIG. 6.
FIG. 8 is a sectional view taken along lines 8—8 of FIG. 6.
FIG. 9 is a perspective view of one and a portion of another of the table sections in the curved sectional run-out table and guide assembly of FIG. 1.
FIG. 10 is a sectional view taken along lines 10—10 of FIG. 9.

The sectional run-out table 21 shown is comprised of a plurality of table sections 27 of a corresponding size and shape arranged end-to-end that are pivotally and releasably connected together at a joint at the discharge end of one and the feed end of the next table section. The number of the table sections 27 that are used for a given building depends on the length of the panel being formed, which will depend upon the size of the building or like structure being constructed. Each table section 27 shown comprises a channel-shape top member 28 having a leg assembly 29 pivotally connected at and supporting the discharge end of the top member 28. Each table section is collapsible in that the leg assembly 29 swings from an extended position as shown to a collapsed position where the leg assembly 29 is folded back against the top member 28 whereby the table sections can be more readily transported and stored. When two table sections are connected end-to-end as shown in FIG. 6, the leg assembly at the discharge end of a trailing table section provides the support for the feed end of the next table section.

Each table top member 28 shown is made from a length of metal channel arranged in an inverted position that has a flat web 30 and and opposed depending side flanges 31 and 32. The web 30 has square corners at the trailing or feed end and a pair of beveled or inwardly tapered edge 33 and 34 terminating in a flat narrowed edge 35 at the discharge or leading end. A generally square plate 37 is welded to the underside of the discharge end portion of the top member and a depending bolt 38 is affixed thereto as by welding so that the bolt 38 provides a male joint portion that extends through an aperture forming a female joint portion in the top member at the adjacent trailing or feed end of the next adjacent table top member so as to provide both a releasable and a pivotal joint connecting adjacent end-to-end table sections 27. In this way the bolt 38 and slot in the table to provide pivotal joint portions and a wing nut 39 threads on bolt 38 which releasably holds the table sections together.

The leg assembly 29 pivotally fastened to the top member 28 is comprised of a pair of oppositely disposed vertically adjustable legs 41 and 42 and a connecting crossbar 43. Each adjustable leg is of a telescoping construction with a hollow outer leg portion 44 that telescopically receives in an inner concentric arrangement an inner leg portion 45. The outer leg portion 44 has an upper portion that extends vertically down from the table top member and a lower portion that inclines laterally out at a slight angle to provide lateral stability. The outer leg portion 44 of each leg 41 and 42 is pivotally fastened at its upper end to a plate 46 affixed to each donwturned flange of the top member and a fastener in the form of a bolt 47 extends through the outer portion and into the plate 46. The inner telescoping leg portion 45 is held at a selected position relative to the outer leg portion 44 by a set screw 48. Each inner leg portion 45 terminates at its lower end in a foot in the form of a laterally extending plate 49 with the plate 49 having an aperture 51 and a length of upright tubing 52 welded thereto to form a stake socket for receiving a stake 53 for the releasable anchoring of the leg assembly to the ground as best seen in FIG. 8.

The feed end of the first table section 21 is releasably fastened to the panel forming apparatus 13 as shown in FIG. 4 by means of an angle member 54 on the frame that has a plate 55 welded to the underside of the top leg of angle member 54 and has one or more laterally spaced bolt holes 56 that align with holes 57 in the top member 28. This plate 56 forms a supporting ledge for the top member 28 of the first table section and it is held by one or more bolt fasteners 58 that extend through the apertures in the top member 28 and the plate 55 and have a wing nut holding the top member against accidental displacement.

The sectional support 22 is comprised of a plurality of similar generally angle-shaped structures as viewed from the end, each structure having a lateral member 59 elevated above the supporting surface, which is usually the ground, and supported by an adjustable leg assembly 60. One end of the lateral member 59 is attached at a point below the upper end of the leg to provide a stub portion 57 which may serve to limit the lateral movement of a panel supported thereon. The lateral member 59 removably inserts into a tubular socket 61 welded to a side flange of the top member and is releasably held therein by a set screw 62. The adjustable leg assembly 60 is similar in construction to leg assembly 29 and includes an outer leg portion 63, an inner leg portion 64 telescopically received and slidable in outer leg portion 63, a foot plate 66 with an aperture on the lower end of inner leg portion 64 and a tube 67 on foot plate 66 forming a stake pocket that facilitates the anchoring of the support assembly to the ground.

The run-out table and guide assembly 23 generally has a table structure similar to that of the run-out table 21 above described, including a plurality of table sections designated by numeral 70 arranged end-to-end. Each table section 70 has a top member 28 and a leg assembly 29 pivotally connected thereto and arranged to swing between the extended position shown and a collapsed position. In addition, however, the top member has a guide roller 71 mounted thereon for rotation about a vertical axis. The roller is positioned in an upstanding manner on the top member and closer to the leading end and offset to one side of the longitudinal center line whereby to serve as a guide for guiding the path of the curved panel along a selected radius as th panel is forced out from the curving section 17.

As best seen in FIG. 10, this guide roller 71 shown is comprised of an outer cylindrical tube 73 with an upper end plate 74 and a lower end plate 75 closing the ends thereof. A shaft 76 is mounted in an inner concentric arrangement in the tube 73 and is supported on an upper bearing 77 carried by the upper plate and a lower bearing 78 carried by the lower plate. An upper holding collar 81 is releasably affixed to the shaft by a set screw and rests on the upper bearing 77 and a lower holding collar 82 is releasably affixed to the shaft by a set screw below the lower bearing 78. The shaft 76 extends through an aperture in the top member 28 and an aperture in a plate 83. A holding collar 84 is releasably fastened to shaft 73 and a plate 83. In this way the roller is releasably inserted into the top of the table and held in place by collar 84.

Figure 11:
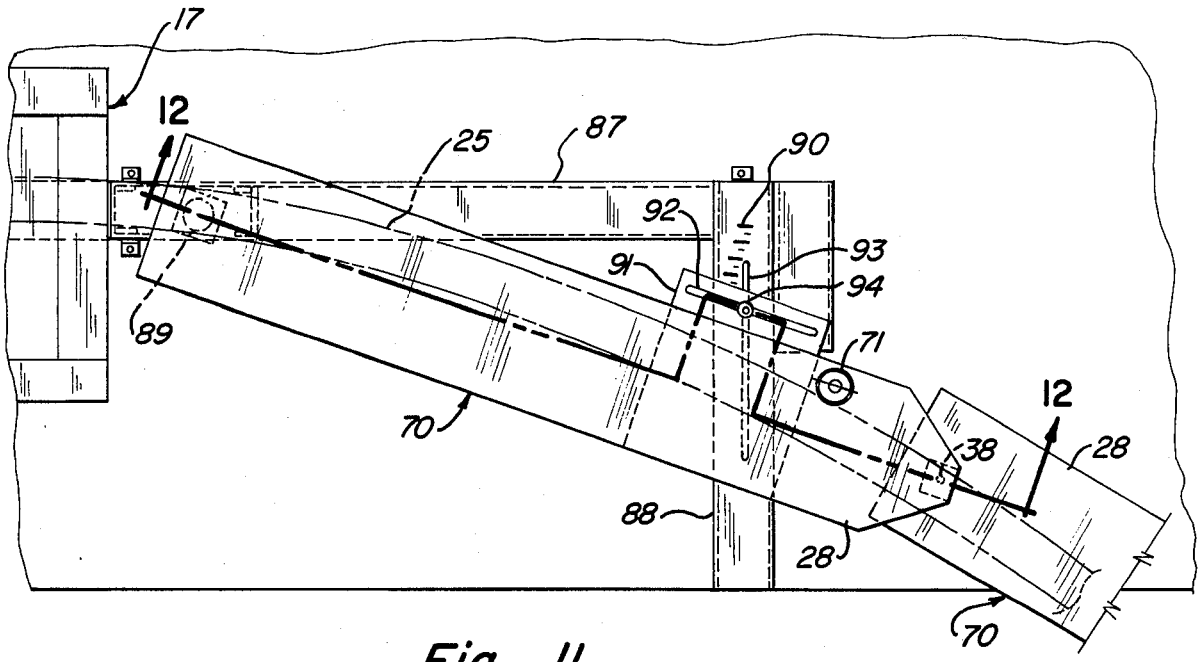
FIG. 11 is a top plan view of the first table section of the run-out table and guide arrangement of FIG. 1.
Figure 12:
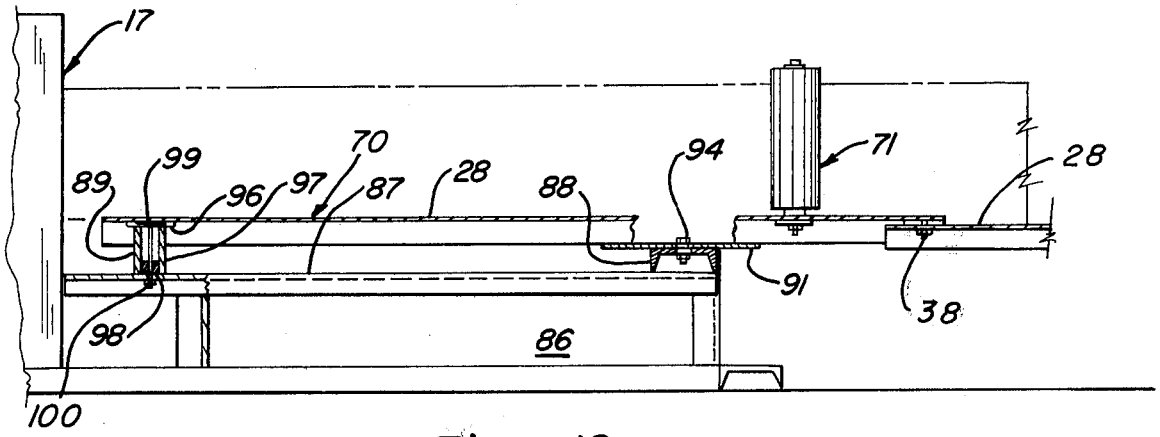
FIG. 12 is a sectional view taken along lines 12—12 of FIG. 11.

Referring now to FIGS. 11 and 12, the first table section 70 is immediately adjacent the curving section 17 of the forming and curving apparatus 11 and is arranged with a platform or base 86 having a support channel 87 extending longitudinally of the curving section and in the direction of the panel movement and a support channel 88 supported or extending from one end of channel 87 at right angles thereto. A pivot assembly 89 is mounted on the support channel 87 adjacent the feed end and is affixed to the top member 28 for the pivotal movement thereof. A plate 91 having a slot 92 is affixed to the underside of the top member 28 and a slot 93 is provided in channel 88 whereby by means of a bolt 94 in the slots 92 and 93 the angular portion of the table member can be preset. In this way the angle of the curvature can be established by sliding the bolt 94 along the slots 92 and 93, and channel 88 may be provided with calibrations or lines 90 if desired.

In practice, the angle of the first table top section 70 may be set by running out a length of the curved panel 25, anchoring the bolt 94, attaching a second table section 70, running out an additional length of panel over the second table section, setting the position of the second table section 70, and so on. An alternate to this procedure would be to use a tape radius to set the positioning of the curved table section 70 for establishing the desired arc according to the arc or curvature in the panel being shaped by the curving section. The pivot assembly 89 shown comprises a plate 96 affixed to the underside of member 28, a tube 97 affixed to plate 96, a flange 98 affixed to channel 87, and a bolt or shaft 99 affixed to plate 96 and extending down through flange 98 and an aperture in channel 87 and held by a nut or collar 100 under channel 87.

OPERATION

In the operation and procedure for forming and shaping the panels, the forming and curving apparatus 11 is transported to the job site and the run-out table 21 is set up using the necessary number of table sections 27 for a particular panel length. The necessary number of support sections 22 are positioned and locked in place and the run-out and guide assembly 23 is set up and arranged along a radius of curvature according to that established by the curving section 17. In each case the table sections are leveled to provide a level, horizontal supporting surface for the panels by adjusting the legs, and once properly positioned a stake is driven into each of the stake pockets to maintain the legs at a fixed position. Once set up in this way, numerous panels may be run out and supported without materials adjustments. The panels are first formed in the forming section, run out onto the run-out table 21, manually moved to the sectional support 22, turned on one side, and then fed into the curving section 17. The panels are forced out of the curving section 17 where they are then supported on the table top members of the assembly 23 and maintained in a selected radius by each successive guide roller 71 as the flanges of each panel move against the guide rollers. Finally, the curved panels 25 are removed from assembly 23 and seamed at the flanges as shown in FIG. 2 and then placed in position on the building by a crane or the like.

Although the present invention has been described with a certain degree of particularly, it is understood that the present disclosure has been made by way of example and that changes in details of structure may be made without departing from the spirit thereof.

What is claimed is:

1. Run-out apparatus for use in combination with an apparatus for forming and curving panels having a forming section and a curving section, said run-out apparatus comprising:

table means in receiving relation to the forming section providing a supporting surface onto which a formed panel is run and supported as the formed panels runs out from said forming section, support means adjacent said table means onto which the formed panel is positioned for feeding into said curving section, and table and guide means including support surface portions for supporting a down-facing surface of the curved panel for sliding movement thereon and guide surface portions extending substantially normal to and projecting away from said support surface portions at spaced intervals along the course of travel for the curved panel established by said support surface portions against which the curved panel is slidably moved to be guided through a selected curved path as the curved panel is run out from said curving section.

2. Run-out apparatus as set forth in claim 1 wherein said table means includes a selected number of table sections releasably connected end-to-end.

3. Run-out apparatus as set forth in claim 2 wherein each table section includes a top member and a leg assembly connected to said top member, said leg assembly being vertically adjustable to level the top member.

4. Run-out apparatus as set forth in claim 3 wherein said top member has a first joint portion at the feed end and a second joint portion at the discharge end complementary to the first joint portion for the releasable and pivotal connection of pairs of said table sections end-to-end.

5. Run-out apparatus as set forth in claim 3 wherein said leg assembly is pivotally connected to said top member to move between an extended position wherein the top member is supported at an elevation about a supporting surface and collapsed position whereby the leg assembly is folded back against said top member.

6. Run-out apparatus as set forth in claim 3 wherein said leg assembly includes a pair of oppositely disposed vertically adjustable legs and a connecting crossbar, each said adjustable leg including an outer leg portion that extends down and laterally out from the top member in the extended position and an inner member telescopically received in and slidably movable in said outer leg portion, said inner leg portion having a foot with a stake pocket for the anchoring of said leg assembly to a supporting surface, and means to lock the outer and inner leg portions together at a selected position.

7. Run-out apparatus as set forth in claim 2 wherein said support means includes a support section associated with each said table section, each said support section including a lateral support member and an adjustable leg assembly connected to said lateral support member, said lateral support member and adjustable leg assembly being arranged at right angles to one another.

8. Run-out apparatus as set forth in claim 7 wherein said adjustable leg assembly includes an outer leg portion and an inner leg portion telescopically received in and slidable within the associated outer leg portion, said inner leg portion having a foot with a stake pocket for the anchoring of said leg assembly to a supporting surface, and means to lock the outer leg portion and the inner leg portion at a selected position.

9. Run-out apparatus as set forth in claim 1 wherein said table and guide means includes a selected number of table sections releasably connected end-to-end, each said table section having a top member with a sustantially planar top-supporting surface for supporting the curved panels for sliding movement thereon and a guide on the top member arranged to direct the curved panel along a curved path that will maintain the curvature formed in the panel by the curving section.

10. Run-out apparatus as set forth in claim 9 wherein each said guide is in the form of a roller arranged to rotate freely about a vertical axis.

11. Run-out apparatus as set forth in claim 9 including means pivotally supporting a first of said table sections adjacent the curving section for swinging movement in a horizontal plane about a vertical axis at a selected angle to a longitudinal course of travel in a direction straight out as the curved panel exits the curving section to position the guide to maintain the curvature produced in said curving section.

12. Run-out apparatus as set forth in claim 11 including releasable locking means to lock said lock first table section at said selected angular position.

13. Run-out apparatus as set forth in claim 12 wherein said releasable locking means includes a plate on said table section with a first slot and a support arranged normal to said longitudinal course of travel with a second slot and fastening means extending through said slots to lock said plate to said support at a selected position.

14. Run-out apparatus as set forth in claim 9 wherein each said top member has a first joint portion at the feed end and a second joint portion at the discharge end complementary to said first joint portion for the releasable and pivotal connection of a pair of said table sections end-to-end.

15. Run-out apparatus for use in combination with an apparatus for forming panels from a roll of sheet metal having a forming section and a curving section, said run-out apparatus comprising:

a sectional run-out table inclusive of a selected number of table sections connected end-to-end, each said table section having a top member providing a planar supporting surface onto which a formed panel is run and supported as the formed panel continuously runs out from said forming section;

a sectional support adjacent said sectional run-out table onto which the formed panel is positioned for feeding into said curving section, said sectional support including a support section associated with each table section, each said support section having a lateral support member releasably inserted at one end into a socket on an associated table section and an adjustable leg assembly connected to and arranged at right angles to said lateral member; and a sectional run-out table and guide assembly inclusive of a selected number of table sections connected end-to-end, each said table section having a top member providing a planar supporting top surface and a guide roller projecting up from the top surface of said top member to provide a guide surface for maintaining the curved panel in a selected curve as the curved panel is run out from said curving section.

16. Run-out apparatus as set forth in claim 15 wherein said sections of said run-out table, support, and run-out table and guide assembly each have panel-supporting surfaces and each have adjustable leg assemblies positioned to locate associated panel supporting surfaces in a substantially level position, each leg assembly having the lower ends anchored to the supporting surface to retain the panel supporting surfaces in a fixed position as the panel is moved relative thereto.

17. Run-out apparatus as set forth in claim 15 wherein said leg assemblies are pivotally connected at the discharge end of each top member and the leg assembly of one table section supports the feed end of the top member of the adjacent table section.

18. Run-out apparatus as set forth in claim 15 wherein each said top member is in the form of an inverted channel having a flat web and depending flanges on opposite sides thereof, the discharge end portion of the channel having tapered sides that taper inwardly toward the discharge end.

19. Run-out apparatus as set forth in claim 15 wherein the first of said table sections of said run-out table is releasably supported adjacent the curving section for support of the feed end and ready attachment to and detachment from said curving section.

20. Run-out apparatus as set forth in claim 15 wherein said guide roller includes an outer cylindrical tube and a shaft in inner concentric arrangement within said tube mounted on upper and lower bearings that rotatably support said outer cylindrical tube for free rotational movement, said sheet extending down through the associated top member and being releasably fastened to said top member.

21. Run-out apparatus as set forth in claim 15 wherein each said top member has a feed end and a discharge end, the feed end having an aperture providing a female joint portion and the discharge end having a depending threaded bolt affixed thereto providing a male joint portion whereby the threaded bolt of one top member inserts into the aperture in the next top member and a nut threads on the bolt to fasten a pair of said top members together, the discharge end portion of one top member overlapping, resting on and being supported by the feed end of the next top member.

22. A method of handling panels formed continuously from sheet material comprising the steps of:

supporting the panels on a planar support surface as a shaped panel runs out from a forming section, supporting the panel at the feed end of a curving section that imparts a curve to the generally U-shaped panel in an orientation ready for feeding to a curving section, and simultaneously supporting and guiding the formed panels through a curve having a selected radius to maintain the curvature in the curved panel as the curved panel is run out from said curving section.

23. A method as set forth in claim 22 including the further step of changing the length of said planar support surface as the length of the panel changes.

24. A method as set forth in claim 22 including the further step of changing the radius of curvature of the guiding step as the curvature in the panel is changed.

25. A method as set forth in claim 22 including the further step of fixing said planar support surface, the panel support at the feed end and the support and guiding for the formed panels at a fixed position for the forming of a plurality of panels of the same size and curvature.

* * * * *